US005101917A

United States Patent [19]

Abdul et al.

[11] Patent Number: 5,101,917

[45] Date of Patent: Apr. 7, 1992

[54] IN-PLACE SOIL SAMPLER

[75] Inventors: Abdul S. Abdul, Troy; Thomas L. Gibson, Utica; Alva E. Fincham, Farmington Hills, all of Mich.

[73] Assignee: General Motors Corporation, Detroit, Mich.

[21] Appl. No.: 542,615

[22] Filed: Jun. 25, 1990

[51] Int. Cl.[5] ..... E21B 49/02

[52] U.S. Cl. ..... 175/253; 175/58

[58] Field of Search ..... 73/864.44, 864.45; 175/58, 226, 249-255, 403, 404, 405, 246

[56] References Cited

U.S. PATENT DOCUMENTS

| | | | |
|---|---|---|---|
| 1,655,644 | 1/1928 | Baker | 175/249 X |
| 2,126,684 | 8/1938 | Humason et al. | 175/251 X |
| 2,314,352 | 3/1943 | Hoffoss | 175/249 X |
| 3,092,192 | 6/1963 | Deely | 175/253 |
| 3,363,705 | 1/1968 | Jensen | 175/226 |
| 3,630,296 | 12/1971 | Bullard | 175/58 X |
| 3,768,580 | 10/1973 | Mann et al. | 175/251 |
| 3,807,234 | 4/1974 | Duperon | 175/249 X |
| 4,667,754 | 5/1987 | Diedrich | 175/249 |
| 4,916,945 | 4/1990 | Weisbrod | 73/153 |
| 4,946,000 | 8/1990 | Gibson et al. | 175/251 |

FOREIGN PATENT DOCUMENTS

| | | | |
|---|---|---|---|
| 1241157 | 5/1967 | Fed. Rep. of Germany | 175/249 |
| 165717 | 9/1984 | Japan | 175/249 |

*Primary Examiner*—Tom Noland

*Attorney, Agent, or Firm*—George A. Grove

[57] ABSTRACT

An in-place soil sampler assembly includes an outer barrel or tube coupled to a corer point at one end thereof. An inner samping tube is contained within the outer tube. A soil sample retainer has a support ring connected to one end of the inner sampling tube. The support ring carries a plurality of flexible arcuate leaves each having a base portion secured to the ring and each having an apex moveable with respect to the support ring between opened and closed position. A collar is mounted at the end of the outer tube to form a cavity for receiving the soil sample retainer when the leaves are opened for passage of a soil sample from the corer point into the inner sampling tube; the leaves are closed when the support ring is removed from the cavity so as to form a convex soil sample support surface facing in the direction of the inner sampling tube for holding a soil sample therein. The inner sampling tube and soil sampler retainer are removable from the outer tube as a unit while the outer tube remains in place to avoid disturbing soil samples taken from succeeding core sections.

6 Claims, 1 Drawing Sheet

FIG 1
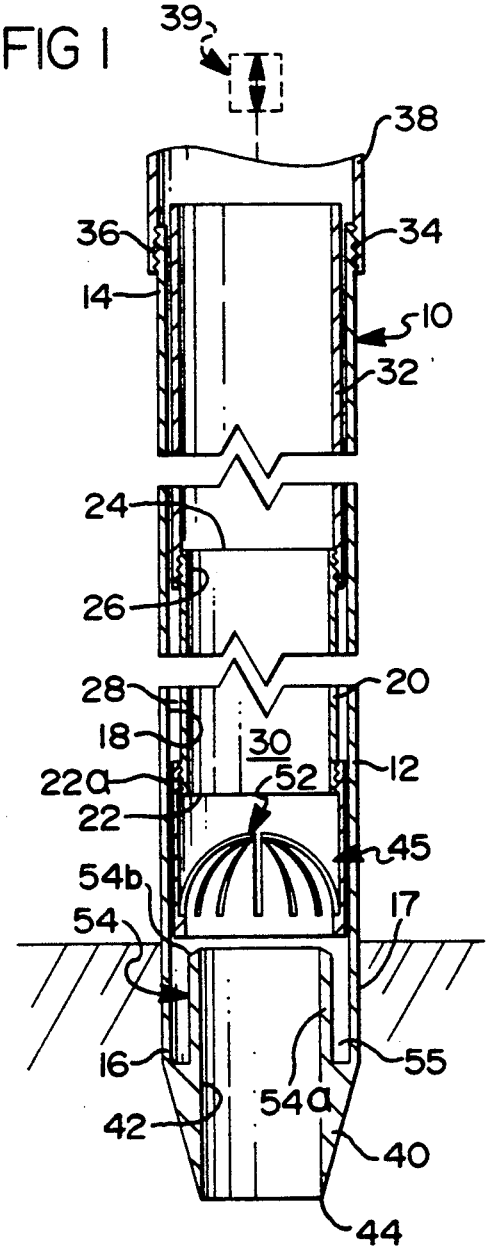
FIG 2
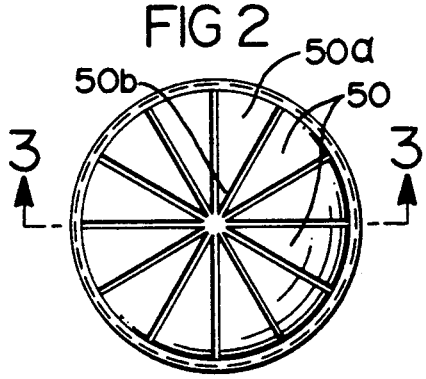
FIG 3
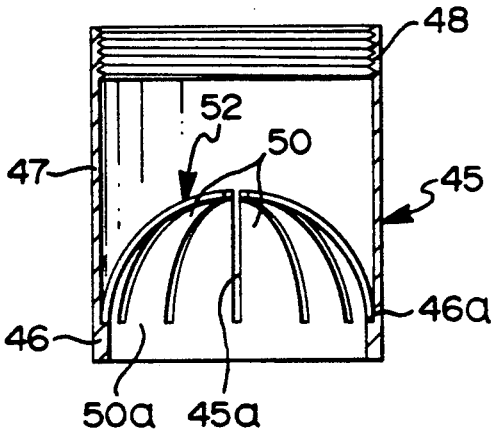
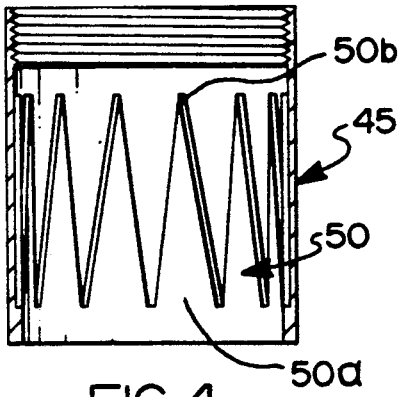
FIG 4
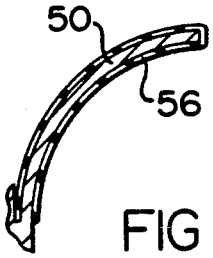
FIG 5

IN-PLACE SOIL SAMPLER

FIELD OF THE INVENTION

This invention relates to soil sampler assemblies and more particularly to soil sampler assemblies for coring soil samples from the ground at succeedingly lower levels.

BACKGROUND OF THE INVENTION

Soil sampler assemblies are known in which an inner tube is telescoped within an outer tube and a soil sample retainer is located within the outer tube. The soil sample retainer is operative to close an open end of the inner tube when it is withdrawn slightly following entry of a soil sample into the inner tube. Thereafter both the outer and inner tube are withdrawn from the ground to examine the soil sample captured within the soil sampler assembly. While suitable for their intended purpose such soil sampler assemblies disturb the soil at the bottom of the test hole as the soil sampler assembly is removed from the test hole. Such assemblies are not suitable for retrieving a series of undisturbed soil samples at different depths of a single test hole.

Recently, it has been found desirable to accurately determine the extent of contamination at different depths through soil and groundwater zones where oil and other materials have been spilled onto a sandy or otherwise fluid permeable soil. In most cases contaminants are isolated within a few feet of the ground surface but the depth and the perimeter of the spill affected ground material may vary. In order to provide accurate three dimensional profiling of the extent of soil contamination it is desirable to take soil samples at a number of locations through the contamination site. Successively deeper soil samples are needed from each of the test holes in order to determine the precise location of the contaminants beneath the ground surface.

SUMMARY OF THE INVENTION

A feature of the present invention is to provide an in-place soil sampler which will permit a series of soil samples to be taken from a single test hole without removing an outer tubular corer from the test hole as succeedingly lower depths of soil are sampled.

A further feature of the present invention is to provide such in-place soil sampling by use of an outer tube which has a corer point thereon adapted to be driven into the, ground to different depths in a single test hole and wherein an inner soil sampling tube and an associated soil retainer are constructed and arranged to be located within the outer tube so as to be removable from the outer tube following soil sampling at each succeeding test depth without removing the outer tube and corer point from the test hole while retrieving and examining succeedingly deeper, undisturbed soil samples from the in-place outer tube in each test hole.

A still further feature of the present invention is to provide for such in-place, successive depth retrieval of soil samples by use of a soil sample retainer which includes a support ring connected to the inner soil sampling tube at the bottom end thereof and which retainer further includes a plurality of flexible arcuate leaves, each having a wide base segment and an apex. The wide base segments are connected to the support ring and the apexes are bent to form a convex surface for supporting soil samples retained within said inner tube as the inner tube is removed from the in-place outer tube.

An object of the present invention is to provide a release member on the outer tube for engagement with the support ring and flexible arcuate leaves of the retainer to open the flexible arcuate leaves to form an opening therethrough for passage of a soil sample into the inner tube; the support ring and release member operating to release the flexible arcuate leaves into a closed position for retaining the soil sample within the inner soil sampling tube as it is removed from the in-place outer tube.

A still further object of the present invention is to provide a layer of resilient material on the flexible arcuate leaves to seal between the flexible arcuate leaves when they are closed so as to hold both fluid and solids within the inner soil sampling tube as a soil sample is removed from the in-place soil sampler apparatus.

These and other features, objects and advantages of the present invention will become more apparent when reference is made to the following description and accompanying drawings wherein:

BRIEF DESCRIPTION OF THE DRAWINGS

FIG. 1 is a longitudinal sectional view of an in-place soil sampler assembly in accordance with the present invention;

FIG. 2 is a fragmentary sectional view of a retainer in the apparatus of FIG. 1 shown in a closed position;

FIG. 3 is a sectional view, in the direction 3—3 of FIG. 2, of a retainer of the present invention in its closed position;

FIG. 4 is a sectional view, in the direction 3—3 of FIG. 2, of a retainer of this invention in its open position; and FIG. 5 is a fragmentary sectional view of a flexible arcuate leaf in another embodiment of the invention.

DETAILED DESCRIPTION OF A PREFERRED EMBODIMENT OF THE INVENTION

Referring now to FIG. 1, an in-place soil sampler assembly 10 is illustrated. The assembly 10 includes an in-place outer tube 12 having an upper end 14 and a lower end 16. The outer tube 12 also has an outer surface 17 and an inner surface 18. The outer surface 17 engages the surrounding ground surface in which the sampler 10 is located and defines the diameter of a test hole from which soil samples are to be removed.

An inner soil sampling tube 20 is located within the outer tube 12. The inner tube 20 has a lower open end 22 an upper end 24 and inner and outer surfaces 26, 28. The inner surface 26 is cylindrical and defines a soil sample cavity 30 for receiving soil samples through the lower open end 22. The upper end 24 is threadably connected to the lower end of a rod or pipe 32 that has an upper end accessible from above ground level. In the illustrated arrangement only one segment of the rod or pipe 32 is shown. If a deep test hole is to be sampled the rod or pipe 32 can be extended by threading additional rod or pipe segments (not shown) to the rod or pipe 32 illustrated in FIG. 1.

The upper end 14 of the outer tube 12 has a threaded collar 34 thereon which is threadably connected to a threaded end 36 of an adapter 38. The adapter 38 attaches to a reciprocable rod of drill apparatus 39 to provide the driving force for the in-place soil sampler 10. The lower end 16 of the outer tube 12 is connected to a tapered metal point 40 which has a cylindrical inner surface 42 which is filled with a soil sample as the tip 44 of the point 40 penetrates the ground for sampling succeeding layers of ground material by an operation of the in-place soil sampler to be described hereinbelow.

A soil retainer 45 is supported on the lower open end 22 of the inner tube 20. The soil sample retainer 45 has a support ring 46 carried on one end of a tubular closure member 47. The closure member has a threaded upper end 48 that is threadably connected to a threaded surface 22*a* on the lower open end 22 as shown in FIG. 1. A plurality of flexible arcuate leaves 50 extend from the support ring 46. More particularly, each of the leaves 50 have a wide base segment 50*a* joined to the support ring 46 at the inner surface 46*a* thereof. Each of the leaves 50 further include an apex 50*b*. The apexes 50*b* are located in close proximity as shown in FIG. 2 when the retainer 45 is closed. The leaves 50 combine to form a convex soil support surface 52 closing the soil sample cavity 30 when the retainer 45 is closed.

The outer tube 12 has a retainer release member 54 supported at the lower end 16. The release member 54 includes an annular collar 54*a* with a tapered upper end 54*b* that diverges downwardly into a concentric cavity 55 formed between the release member 54 and the lower end 16 of the outer tube 12. The concentric cavity 55 is open at the upper end thereof and closed at the lower end thereof and is configured to receive the support ring 46, the tubular closure member 47 and the leaves 50 when the retainer 45 is opened to receive the soil sample as assembly 10 is driven into the ground.

The leaves 50 are made from a spring metal material so that they can be moved from a closed position shown in FIGS. 1, 2 and 3 to an open position shown in FIG. 4.

In another embodiment of the invention shown in FIG. 5, the leaves 50 are each covered with a layer 56 of elastic impermeable material (rubber, Buna-N material or polymeric elastomers) of a thickness to close the gaps 45*a* shown in the embodiment of FIGS. 1–4 when the leaves 50 are closed. This embodiment permits liquid and solid soil samples to be retained in the inner tube 20.

In operation, the in-place soil sampler 10 is conditioned to open the retainer 45 therein by pressing the rod or pipe 32 into the outer tube 12. The inner soil sampling tube 20 and the retainer 45 thereon are thus driven toward the lower end 16 of the outer tube 12 until the support ring 46 engages the tapered upper end 54*b* of the release member 54 so as to cause each of the leaves 50 to fold upwardly toward the interior surface of the tubular closure member 47 so as to become aligned with the concentric cavity 55 for entry therein until the tapered upper end 54*b* seats against the lower end 22 of the inner tube 20. At this point the retainer 45 is triggered fully open as shown in FIG. 4.

The soil sampler assembly 10 is then driven into the ground surface a predetermined first distance to take a core sample of a desired depth. Usually the soil sampler assembly 10 is driven into the ground from a zero reference at the ground surface to a depth of approximately two feet (0.61 meter). The metal point 40 penetrates the ground to core a soil sample for passage across the cylindrical inner surface 42, the interior of the annular collar 54*a*, thence directly into the soil sample cavity 30. Then the inner soil sampling tube 20 is raised upwardly in the in-place outer tube 12 causing the leaves 50 to be moved from the cavity 55. The leaves 50 are thereby free to spring inwardly to their closed position so as to capture a soil sample between the convex surface 52 and the soil sample cavity 30. The inner soil sampling tube 20 and closed retainer 45 are then completely removed from the in-place outer tube 12 which remains seated in the ground so that the soil around the soil sampler assembly 10 and below the point 40 will remain undisturbed.

Once the inner tube 20 and retainer 45 are removed from the ground, the retainer 45 is unthreaded from the inner tube to provide access to the soil sample. Succeeding series of soil samples are removed from the same test hole by inserting a new inner tube 20 and retainer 45 into the in-place outer tube 12 until the retainer 45 is reset to an open position. Once the leaves 50 are returned to their open position by bottoming the support ring 46 on the lower end 16, the in-place outer tube 12 is driven into the ground a predetermined additional depth to take another undisturbed soil sample from the ground. The process is continued until the desired depth is sampled by a successive number of core samples.

The invention has been described in an illustrative manner, and it is to be understood that the terminology which has been used is intended to be in the nature of words of description rather than of limitation. Obviously, many modifications and variations of the present invention are possible in light of the aforesaid teachings. It is, therefore, to be understood that within the scope of the appended claims, the invention may be practiced otherwise than as specifically described.

The embodiments of the invention in which an exclusive property or privilege is claimed are defined as follows:

1. In a soil sampler assembly for obtaining undisturbed soil samples including an elongated hollow tubular outer corer means for coring the soil during sampling; said hollow tubular outer corer means including inner and outer surfaces and first and second ends; an elongated hollow tubular inner sampling means defining inner and outer surfaces having first and second ends and disposed within said elongated hollow tubular outer corer means for receiving a soil sample cored by said hollow tubular outer corer means, the improvement comprising:

said inner sampling means supported within said outer corer means for complete removal therefrom;

retainer means adapted to be located within said hollow tubular outer corer means; said retainer means connected to said elongated hollow tubular inner sampling means for movement with said inner sampling means from said outer corer means;

said retainer means including a support ring and a plurality, of flexible arcuate leaves having an opened position and a closed position; each of said flexible arcuate leaves including a base segment connected to said support ring and each of said flexible arcuate leaves having an apex portion located in close spaced relationship when said leaves are in their closed position to form a convex support surface engageable with a soil sample for holding a soil sample within said elongated hollow tubular inner sampling means when said elongated hollow tubular inner sampling means is removed from said outer corer means while said outer corer means remains in the soil without disturbing the surrounding soil; and release means connected to said outer corer means engageable with said retainer means to cause each of said plurality of flexible arcuate leaves to be bent radially outwardly of the inner surface of said elongated hollow tubular inner sampling means to allow a soil sample to be directed from said outer corer means into said elongated hollow tubular inner sampling means as said outer corer means is driven into the soil to be sampled.

2. The assembly as set forth in claim 1 further characterized by said release means being formed an annular collar located radially inwardly of said support ring and having a lower end connected to said outer corer means and said collar further having a free end; said collar and said outer corer means defining a cavity adapted to receive and shield said plurality of flexible arcuate leaves when in their open position so as to be bent radially outwardly of the inner surface of said elongated hollow tubular inner sampling means; said collar having an inner surface for directing a soil sample from said outer corer means for passage therefrom and for deposit in said elongated hollow tubular inner sampling means.

3. The assembly as set forth in claim 4 further characterized by means forming an elastic impermeable covering on each of said flexible arcuate leaves for sealing between each of said flexible arcuate leaves when in their closed position to hold liquid and solid material within said elongated hollow tubular inner sampling means as it si removed form said outer corer means without removing said outer corer means from the surrounding soil.

4. The assembly as set forth in claim 1 further characterized by said retainer means including a tubular closure member of a length greater than the height of said convex support surface; said tubular closure member connected at one end to said elongated hollow tubular inner sampling means and at an opposite end thereof to said base segments of said flexible arcuate leaves to form a passage through said leaves when they are in their opened position.

5. The assembly as set forth in claim 4 further characterized by means forming an elastic impermeable covering on each of said flexible arcuate leaves for sealing between each of said flexible arcuate leaves when in their closed position to hold liquid and solid material within said elongated hollow tubular inner sampling means as it si removed form said outer corer means without removing said outer corer means from the surrounding soil.

6. The assembly as set forth in claim 1 further characterized by means forming an elastic impermeable covering on each of said flexible arcuate leaves for sealing between each of said flexible arcuate leaves when in their closed position to hold liquid and solid material within said elongated hollow tubular inner sampling means as it si removed form said outer corer means without removing said outer corer means from the surrounding soil.

* * * * *